United States Patent [19]

Bayer

[11] Patent Number: 4,817,306

[45] Date of Patent: Apr. 4, 1989

[54] FOOTWEAR ARTICLE WITH ATTACHED CARRYING BAG

[76] Inventor: Earl F. Bayer, 23 Dahlia Rd., Somerset, N.J. 08873

[21] Appl. No.: 131,234

[22] Filed: Dec. 7, 1987

Related U.S. Application Data

[63] Continuation-in-part of Ser. No. 38,140, Apr. 14, 1987, abandoned.

[51] Int. Cl.[4] ..... A43B 23/00; A41D 27/20

[52] U.S. Cl. ..... 36/136; 2/247; 36/1; 36/132; 224/151

[58] Field of Search ..... 36/136, 132, 7.1 R; 2/247; 224/224, 151

[56] References Cited

U.S. PATENT DOCUMENTS

| | | | |
|---|---|---|---|
| 2,742,715 | 4/1956 | Meltzer | 36/2.5 |
| 3,018,570 | 1/1962 | Bliese | 36/1 |
| 3,325,918 | 6/1967 | Weitzner | 36/1 |
| 3,631,613 | 1/1972 | Brettell | 36/2.5 Q |
| 4,280,287 | 7/1981 | Gulbransen | 36/136 |
| 4,404,689 | 9/1983 | DeWan | 2/247 |
| 4,507,882 | 4/1985 | Harrell | 36/136 |
| 4,547,982 | 10/1985 | Gamm | 36/114 |
| 4,563,777 | 1/1986 | Park | 224/151 |
| 4,612,714 | 9/1986 | Gamm | 36/136 |
| 4,638,579 | 1/1987 | Gamm | 36/136 |
| 4,644,673 | 2/1987 | Gamm | 36/136 |

*Primary Examiner*—Stuart S. Levy
*Assistant Examiner*—Thomas R. Hannon
*Attorney, Agent, or Firm*—Watson, Cole, Grindle & Watson

[57] ABSTRACT

A shoe includes a storage pocket and a carrying bag either permanently or detachably attached to the shoe such that the carrying bag can be stored in the storage pocket when not in use or, when needed, can be extended away from the storage pocket and then turned inside out so that the shoe will be contained therein. The carrying bag is made of flexible material and is large enough to carry a companion shoe. The carrying bag can include a tie cord to close the mouth thereof when desired.

17 Claims, 3 Drawing Sheets

FOOTWEAR ARTICLE WITH ATTACHED CARRYING BAG

CROSS REFERENCE TO RELATED APPLICATION

The present application is a continuation-in-part of application Ser. No. 038,140, filed Apr. 14, 1987, now abandoned.

BACKGROUND OF THE INVENTION

Almost everyone has at one time or another found it necessary to carry articles of footwear from one place to another. For example, golfers will frequently carry a pair of golf shoes to the golf course so as to change into them prior to commencing play. Bowlers will frequently carry a pair of bowling shoes to the bowling alley to use during play. Children will frequently carry slippers to a slumber party. Large numbers of office workers who carry their dress shoes to work (while wearing casual shoes or boots during their commute) carry athletic shoes to work for jogging purposes during lunch time. However, carrying such footwear articles is rather awkward (it is hard to carry a pair of shoes individually or by their tied shoe laces) and unattractive. And a carrying bag for the footwear articles may not be readily available, or if available, may be too large or too small.

SUMMARY OF THE INVENTION

Recognizing the need to provide a readily available carrying bag for people who wish to carry one or more footwear articles from one place to another, I have developed the present invention.

My invention comprises a footwear article such as a sports shoe, a dress shoe, a slipper, a boot, etc., which includes a storage pocket, and which also includes a flexible carrying bag attached thereto such that it can be stored in the storage pocket. When referring to sports shoe, I mean any type of athletic shoe such as a sneaker, a golf shoe, a roller skate, a jogging shoe, etc.

Footwear articles which include storage pockets or chambers for storing accessory items are, in and of themselves, known. For example, shoes having storage pockets at the rear ends of their uppers are known (see U.S. Pat. No. 2,742,715), shoes having storage pockets along their side or in their tongues are known (see U.S. Pat. Nos. 4,644,673, 4,638,579, 4,630,383, 4,612,714 and 4,280,287), and high heel shoes having storage compartments in their heels are known (see U.S. Pat. No. 3,325,918). Storage pockets formed in other ways are also known (see U.S. Pat. Nos. 4,547,982, 4,507,882, 3,631,613 and 3,018,570). However, no footwear article is known which includes a storage pocket and a carrying bag for the footwear article, the carrying bag being attached to the footwear article and storable within the storage pocket.

My invention will now be better understood by reference to the accompanying drawings, taken in conjunction with the following discussion.

DETAILED DESCRIPTION OF THE PREFERRED EMBODIMENT

Figure 1:
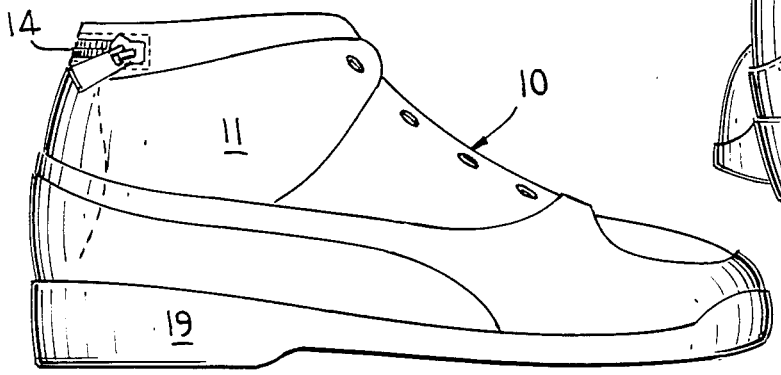
FIG. 1 shows a side elevational view of a footwear article with attached carrying bag in accordance with a preferred embodiment of the present invention, the carrying bag being stored in a storage pocket of the footwear article and thus not observable.

FIGS. 1–6 depict a preferred embodiment of a footwear article with attached carrying bag according to the present invention. It includes a sports shoe 10 formed of an upper 11 and a bottom sole 19. A liner fabric 12 is attached inside the rear portion of the upper 11 so as to form a storage pocket 13 in the shoe, and a closure means in the form of a zipper closure 14 is formed in the rear end of the upper to provide access to the storage pocket 13. A carrying bag 20, which is made out of a flexible material and has a mouth end **20*a*, a main portion 20*b* and a bottom end 20*c*, is attached at its bottom end 20*c* to the liner fabric 12 by connection means 15. The portion of the bag at its mouth end 20*a* is folded over around most of its periphery and attached to the main portion 20*b* to provide a peripheral channel 21. A tie cord 22 extends through the peripheral channel 21 so as to close the mouth of the carrying bag when desired. The connection means 15 which permanently connects the carrying bag to the shoe, is in the form of threads sewn between the bottom portion 20*c* of the carrying bag 20 and the liner fabric 12**.

Figure 2:
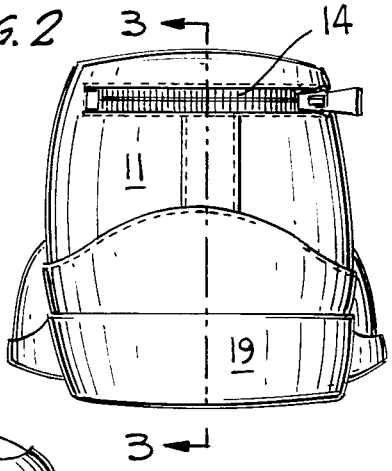
FIG. 2 shows a rear elevational view of the preferred footwear article with attached carrying bag shown in FIG. 1.
Figure 3:
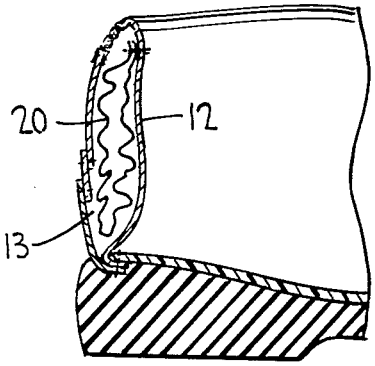
FIG. 3 shows a cross sectional view of the rear portion of the preferred footwear article with attached carrying bag as seen along line 3—3 in FIG. 2.
Figure 4:
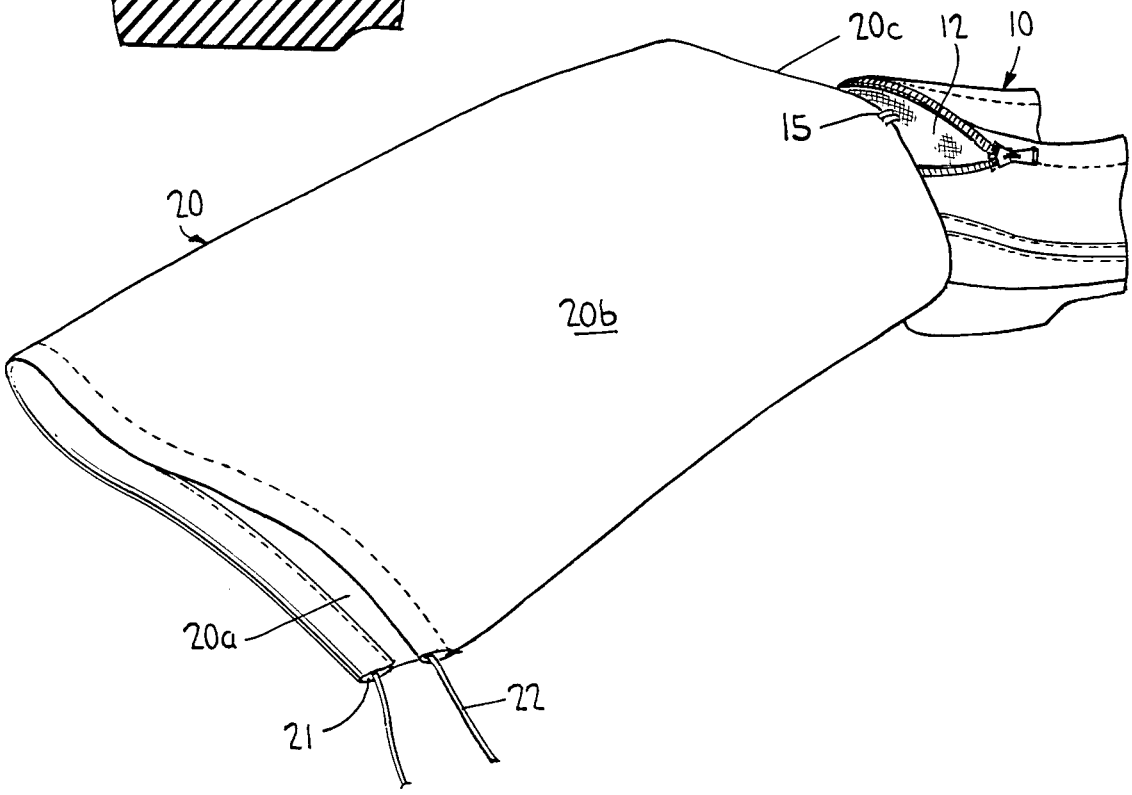
FIG. 4 shows a perspective view of the rear portion of the preferred footwear article with attached carrying bag, the carrying bag being shown extending outwardly from the storage pocket of the footwear article.
Figure 5:
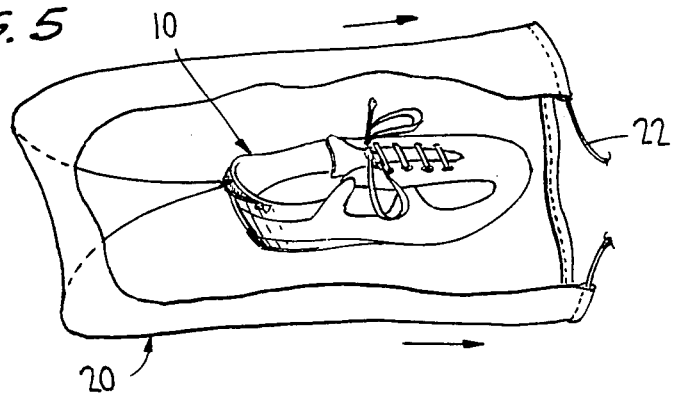
FIG. 5 shows, on a reduced scale, a partially broken away side view of the preferred footwear article with attached carrying bag, the footwear article being shown located within the attached carrying bag, which is in an inside out condition as compared to FIG. 4.
Figure 6:
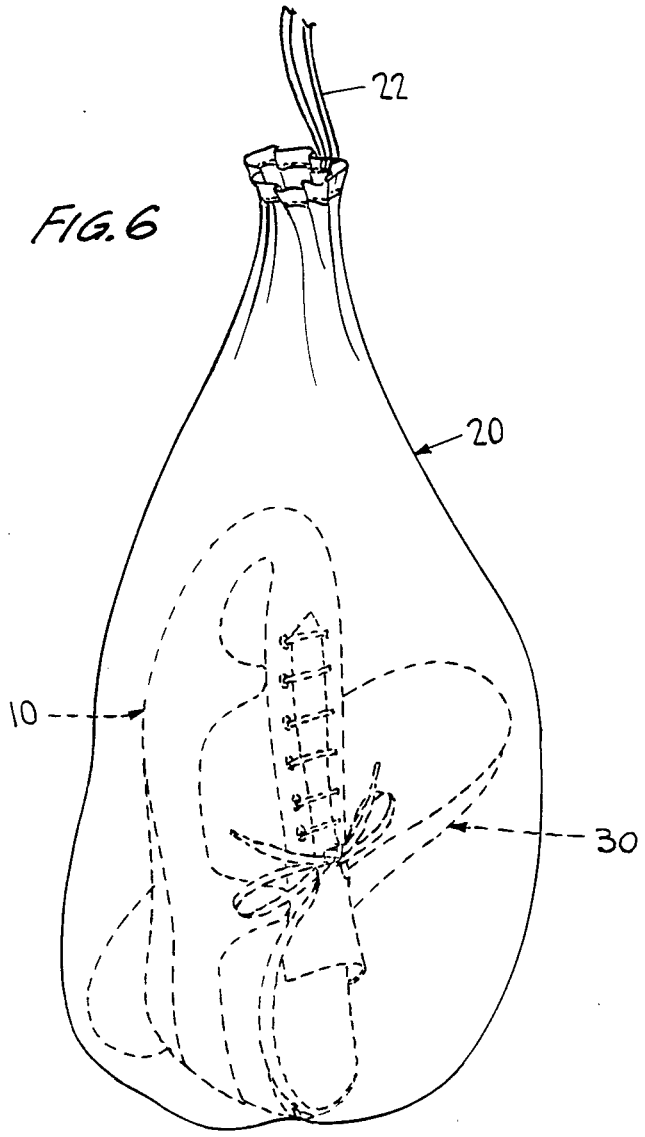
FIG. 6 shows, on an enlarged scale as compared to FIG. 5, a side view of the preferred footwear article with attached carrying bag wherein both the footwear article and a companion footwear article are contained within the attached carrying bag and the mouth of the attached carrying bag is closed.

As shown in FIGS. 1–3, the carrying bag 20 can be folded into a sufficiently compact unit that it can completely fit within the storage pocket 13, thereby allowing the zipper closure 14 to be closed. This represents the non-use condition of the carrying bag. When the carrying bag is to be used, i.e., to carry the sports shoe 10 to which it is attached, the zipper closure 14 is opened and the carrying bag 20 is manually extended outwardly from the storage pocket 13, i.e., as shown in FIG. 4. The carrying bag 20 will not become separated from the sports shoe 10 due to the permanent attachment of its bottom portion **20*c* to the liner fabric 12 by the connection means 15. The carrying bag is then converted to an inside out condition, and in the process the sports shoe 10 will become contained therein, i.e., as shown in FIG. 5. Finally, the mouth of the carrying bag is compressed, i.e., as indicated in FIG. 6, such that the tie cord 22 can be knotted to close the mouth of the carrying bag. The carrying bag is made large enough that, if desired, a companion shoe 30** can also be placed within and carried by the carrying bag. The flexible material of which the carrying bag is made can include nylon, cotton, polyester, etc.

Figure 7:
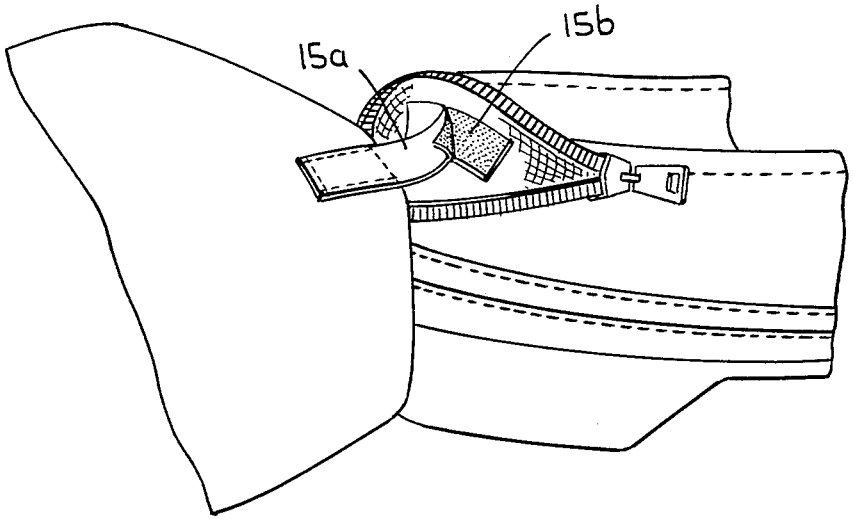
FIGS. 7 and 8 show partial perspective views of footwear articles with attached carrying bags in accordance with further embodiments of the present invention.
Figure 8:
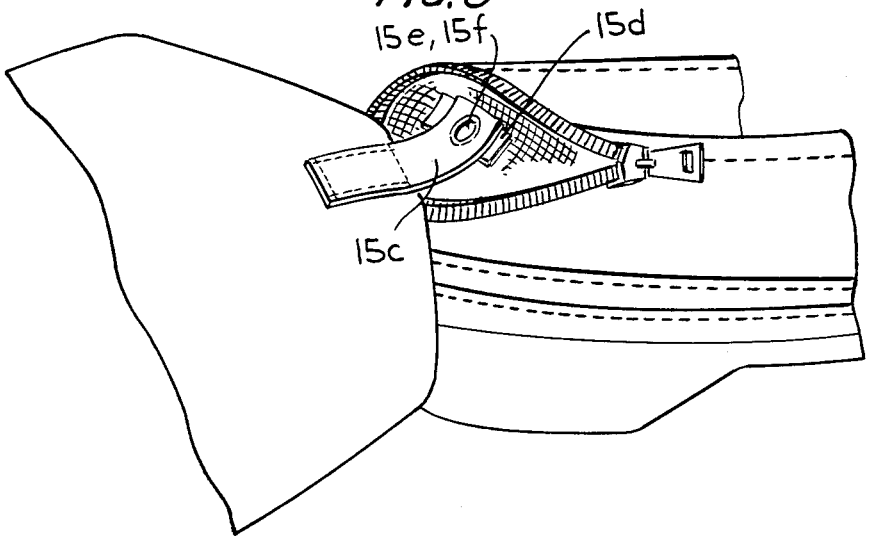

As noted above, the inventive footwear article with attached carrying bag shown in FIGS. 1–6 includes a connection means 15 which acts to permanently attach the carrying bag to the footwear article. As such, forced separation of the carrying ba from the footwear article will result in damage to the connection means. An alternative connection means of this type is bonding glue. However, the invention also contemplates the use of a connection means which will allow the carrying bag to be detached from the footwear article without damage to the connection means, the connection means being means subsequently reusable to reattach the carrying bag to the footwear article. Embodiments of the inventive carrying bag with footwear article having such a connection means are shown in FIGS. 7 and 8. In FIG. 7 the connection means comprises a flap 15*a* and a pad 15*b*, the flap 15*a* being permanently attached at one end to the bottom of the carrying bag and including numerous protruding, hooked-shaped unitary filaments at its other end (e.g. Velcro®-type filaments) and pad 15*b* being permanently attached around its periphery to the liner fabric in the shoe and including numerous protruding, hooked-shaped unitary filaments (e.g. a Velcro® pad). The filaments on the flap 15*a* and pad 15*b* can be randomly engaged to attach the carrying bag to the shoe or disengaged to separate the carrying bag from the shoe. In FIG. 8 the connection means comprises a flap 15*c* and a pad 15*d*, the flap 15*c* being permanently attached at one end to the bottom of the carrying bag and including a snap fastener stud element 15*e* at its other end and pad 15*d* being permanently attached around its periphery to the liner fabric in the shoe and including a snap fastener base element 15*f* thereon. The snap fastener stud element 15*e* can be snap fit within the snap fastener base element 15*f* to attach the carrying bag to the shoe or disengaged therefrom to separate the carrying bag from the shoe. An alternate connection means of this type can be a zipper fastener wherein the two portions of the zipper are separable from one another at their corresponding ends.

Obviously, many variations in the preferred inventive embodiments as described above could be made and still fall within the scope of the present invention. For example, the footwear article, instead of being a sports shoe, could be instead a dress shoe, a casual shoe, a slipper, a boot, etc. Furthermore the storage pocket need not be located at the rear portion of the upper, but can be located at other places on the footwear article, e.g., on one of its sides, at its toe, beneath its tongue, etc.

I claim:

1. A footwear article with attached carrying bag which comprises an upper, means attached to said footwear article to provide a storage pocket, a carrying bag, and connection means attaching said carrying bag to said footwear article such that said carrying bag can be sufficiently large that, when extended away from said pocket chamber and turned inside out, it will contain the footwear article to which it is attached and a companion footwear article yet can be folded into, a compact unit and stored with said storage pocket when not in use.

2. A footwear article with attached carrying bag as defined in claim 1, wherein said means attached to said upper to provide a storage pocket comprises a liner fabric attached within said upper.

3. A footwear article with attached carrying bag as defined in claim 2, wherein said carrying bag is attached to said linear fabric.

4. A footwear article with attached carrying bag as defined in claim 3, including closure means for opening and closing said storage pocket.

5. A footwear article with attached carrying bag as defined in claim 4, wherein said closure means comprises a zipper.

6. A footwear article with carrying bag as defined in claim 4, wherein said liner fabric is located at the rear portion of said upper.

7. A footwear article with attached carrying bag as defined in claim 1, wherein said carrying bag is made of a flexible material.

8. A footwear article with attached carrying bag as defined in clam 7, wherein said flexible material is nylon.

9. A footwear article with attached carrying bag as defined in claim 1, wherein said connection means is constructed such that said carrying bag can be detached from said footwear article without damage to the connection means and said connection means can be used to subsequently attach said carrying bag to said footwear article.

10. A footwear article with attached carrying bag as defined in claim 9, wherein said connection means comprises a flap which is permanently attached at one end to said carrying bag and which has a plurality of protruding, hook-shaped, unitary filaments at its second end, and a pad which is permanently attached to said footwear article, said pad also including a plurality of protruding, hook-shaped, unitary filaments, the filaments on said flap being engageable with the filaments on said flap being engageable with the filaments on said pad.

11. A footwear article with attached carrying bag as defined in claim 9, wherein said connection means comprises a flap which is permanently attached at one end to said carrying bag and which includes a snap fastener stud element at its second end, and a pad which is permanently attached to said footwear article and which includes a snap fastener base element, said snap fastener stud element being engageable with said snap fastener base element.

12. A footwear article with attached carrying bag as defined in claim 1, wherein said connection means is constructed such that forced separation of said carrying bag and said footwear article will cause damage to said connection means.

13. A footwear article with attached carrying bag as defined in claim 12, wherein said connection means comprises threads sewn between said carrying bag and said footwear article.

14. A footwear article with attached carrying bag as defined in claim 14, wherein said carrying bag defines a mouth, and wherein said carrying bag includes additional closure means at said mouth to close said carrying bag.

15. A footwear article with attached carrying bag as defined in claim 14, wherein a portion of said carrying bag at said mouth is folded over to provide a peripheral channel that extends around most of the periphery of said mouth, and wherein said additional closure means comprises a tie cord which extends through said peripheral channel.

16. A footwear article with attached carrying bag as defined in claim 12, wherein said footwear article includes a sole.

17. A footwear article with attached carrying bag as defined in claim 16, wherein said footwear article is a sports shoe.

* * * * *

UNITED STATES PATENT AND TRADEMARK OFFICE

CERTIFICATE OF CORRECTION

PATENT NO. : 4,817,306

DATED : April 4, 1989

INVENTOR(S) : Earl F. Bayer

It is certified that error appears in the above-identified patent and that said Letters Patent is hereby corrected as shown below:

Column 3, line 62, after "can be" insert --positioned within said storage pocket, said carrying bag being--

Signed and Sealed this

Twenty-fifth Day of December, 1990

*Attest:*

HARRY F. MANBECK, JR.

*Attesting Officer*

*Commissioner of Patents and Trademarks*